US005403213A

United States Patent [19]

Inaba et al.

[11] Patent Number: 5,403,213

[45] Date of Patent: Apr. 4, 1995

[54] CONNECTOR WITH TERMINAL RETAINING MECHANISM

[75] Inventors: Shigemitsu Inaba; Hidehiko Kuboshima; Hirotaka Fukushima, all of Shizuoka, Japan

[73] Assignee: Yazaki Corporation, Tokyo, Japan

[21] Appl. No.: 132,862

[22] Filed: Oct. 7, 1993

[30] Foreign Application Priority Data

Oct. 8, 1992 [JP] Japan ..... 4-269832

[51] Int. Cl.[6] ..... H01R 13/514

[52] U.S. Cl. ..... 439/752; 439/598

[58] Field of Search ..... 439/596, 598, 752

[56] References Cited

U.S. PATENT DOCUMENTS 4,750,893 6/1988 Sueyoshi et al. ..... 439/596

4,867,712 9/1989 Kato et al. ..... 439/752

FOREIGN PATENT DOCUMENTS 3023313 1/1982 Germany ..... 439/752

61-119285 7/1986 Japan .

63-102183 7/1988 Japan .

*Primary Examiner*—Eugene F. Desmond

*Attorney, Agent, or Firm*—Sughrue, Mion, Zinn, Macpeak & Seas

[57] ABSTRACT

To provide a connector with a terminal retaining mechanism which positively prevents an incomplete fit of a terminal retaining member. The connector includes an outer housing connectable to a mating connector is mounted on an outer side of an inner housing receiving terminals, the outer housing is slidably mounted on the inner housing. A retaining member for the terminals is slidingly moved to be engaged in the inner housing through a window hole formed in the outer housing. The retaining member is projected from the window hole when the retaining member is out of engagement with the terminals, and the retaining member is received in the inner housing when the retaining member is engaged with the terminals, thereby allowing the outer housing to slide in a terminal-connecting direction.

4 Claims, 3 Drawing Sheets

CONNECTOR WITH TERMINAL RETAINING MECHANISM

BACKGROUND OF THE INVENTION

1. Field of Invention

This invention relates to a connector with a terminal retaining mechanism, which is used, for example, with a terminal of an electric automobile, and is capable of determining through a sliding movement of an outer housing whether or not a terminal retaining member is completely fitted.

2. Related art

FIG. 7 is a vertical cross-sectional view of a conventional connector with a terminal retaining mechanism disclosed in Japanese Utility Model Unexamined Publication No. 61-119285.

In this connector 50 with a terminal retaining mechanism, a terminal retaining member 54 is integrally formed on a top wall 52 of a connector housing 51 of a synthetic resin through a thin, flexible hinge 53. The retaining member 54 has a retaining projection 56 depending from its top plate portion 55. A reception groove 57 for receiving the top plate portion 55, as well as a through hole 58 for receiving the retaining projection 56, is formed in the top wall 52 of the connector housing 51.

The retaining projection 56 of the retaining member 54 is engaged with a rear stepped portion 60 of a terminal 59 to thereby prevent a rearward withdrawal of the terminal 59 (A retaining lance 62 on a bottom wall 61 of the housing is also engaged with the terminal to achieve a double lock).

In the above conventional construction, however, there is a possibility that the worker may pass the connector to the next step, with the retaining member 54 half fitted in the housing 51 as indicated in phantom, that is, in an incompletely-retained condition of the terminal 59. In this case, there has been encountered a problem that the terminal 59 is withdrawn rearwardly.

With the foregoing in view, it is an object of this invention to provide a connector with a terminal retaining mechanism, in which a terminal is positively retained by a retaining member.

To achieve the above object, according to the present invention, there is provided a connector with a terminal retaining mechanism wherein an outer housing connectable to a mating connector is mounted on an outer side of an inner housing receiving terminals; the outer housing is slidably mounted on the inner housing; a retaining member for the terminals is slidingly moved to be engaged in the inner housing through a window hole formed in the outer housing; the retaining member is projected from the window hole when the retaining member is out of engagement with the terminals; and the retaining member is received in the inner housing when the retaining member is engaged with the terminals, thereby allowing the outer housing to slide in a terminal-connecting direction.

In the condition in which the retaining member does not retain the terminals, the retaining member is projected outwardly from the window hole in the outer housing, thereby preventing the sliding movement of the outer housing. As a result, the incomplete mounting of the retaining member is detected. When the retaining member is pressed down to completely retain the terminals, the outer housing can be slidingly moved in the terminal connecting direction.

DETAILED DESCRIPTION OF THE PREFERRED EMBODIMENTS

Figure 1:
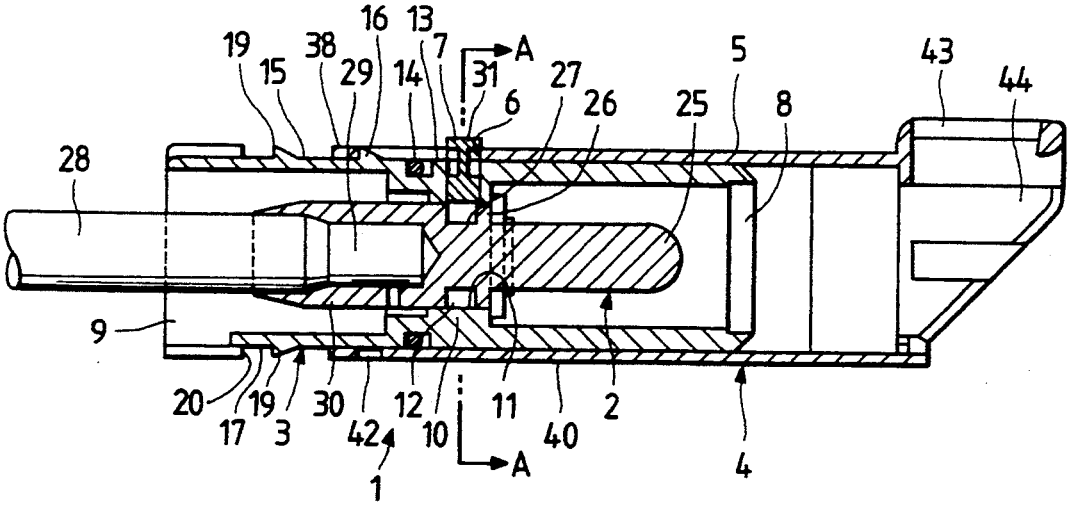
FIG. 1 is a vertical cross-sectional view of a preferred embodiment of a connector of the present invention incorporating a terminal retaining mechanism, showing a terminal retaining member in its provisionally-retained condition.
Figure 2:
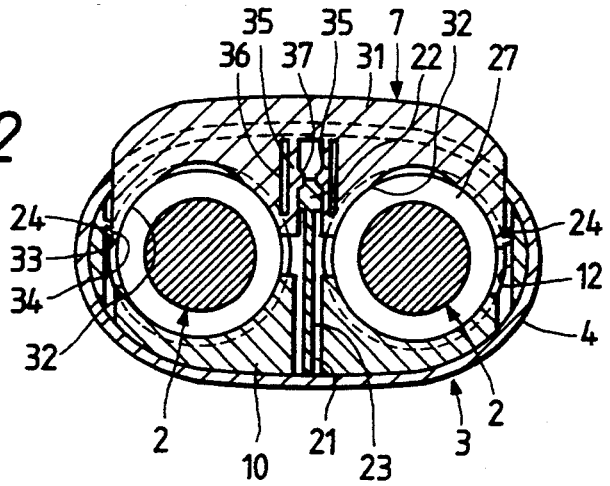
FIG. 2 is a cross-sectional view taken along the line A—A of FIG. 1.
Figure 3:
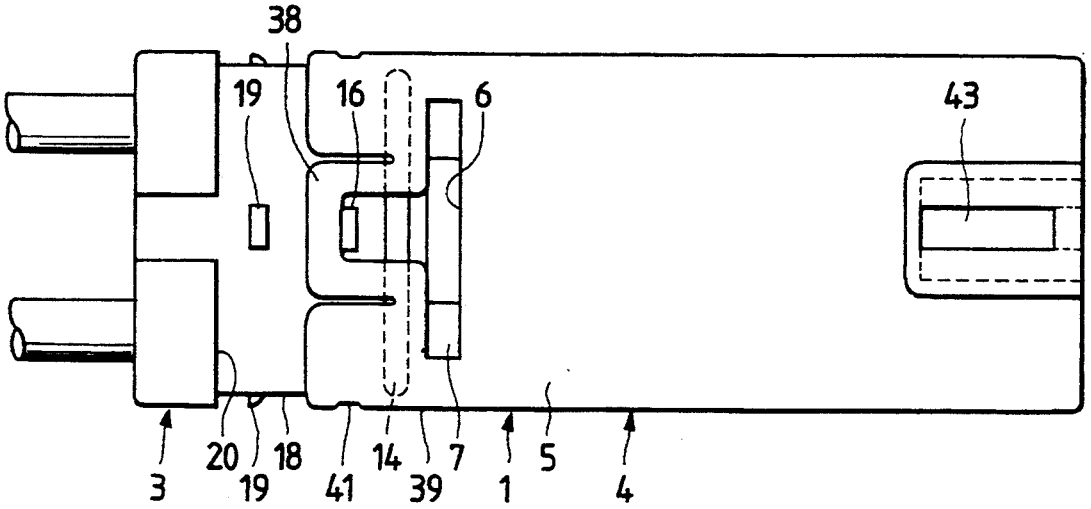
FIG. 3 is a top plan view.

FIG. 1 is a vertical cross-sectional view of a preferred embodiment of a connector of the present invention incorporating a terminal retaining mechanism, FIG. 2 is a cross-sectional view taken along the line A—A of FIG. 1, and FIG. 3 is a top plan view of the connector. In these Figures, a terminal retaining member is shown in a provisionally-retained condition.

The connector 1 with a terminal retaining mechanism comprises a cross-sectionally oval, inner housing 3 of a synthetic resin which receives a pair of pin-like terminals 2 and 2 therein, an outer housing 4 of a synthetic resin which has an oval tubular shape, is slidably mounted on the outer side of the inner housing 3, and is engageable with a mating connector (not shown), and a retaining member 7 of a synthetic resin which is inserted into the inner housing 3 through a window hole 6, formed through a top wall 5 of the outer housing 4, for engagement with the pin-like terminals 2.

The inner housing 3 has a mating terminal insertion opening 8 at its front end, and a pin-like terminal insertion opening 9 at its rear end. The inner housing 3 has a partition wall 10 disposed generally centrally of the length thereof, and a terminal insertion hole 11 is formed through the partition wall 10. A slit-like insertion groove 12 for the retaining member 7 is formed in the inner housing, and extends from the top wall 5 in a direction perpendicular to the path of insertion of the terminal, the insertion groove 12 being communicated with the terminal insertion hole 11. A packing-mounting groove 13 is formed in the outer peripheral wall of the inner housing, and is disposed rearwardly of the partition wall 10. An O-ring 14 is fitted in the mounting groove 13 to provide a waterproof seal between the inner housing and the outer housing 4. A provisionally-retaining projection 16 for the outer housing 4 is formed on the top wall 15, and is disposed rearwardly of the mounting groove 13. A plurality of completely-retaining projections 19 are formed on the top wall 15, a bottom wall 17 and side walls 18, respectively, and are disposed rearwardly of the provisionally-retaining projection 16. An abutment step 20 for the outer housing 4 is formed on a rear end portion of each of the top wall 15 and the bottom wall 17.

As shown in FIG. 2, a vertical slit-like space 21 is formed in the central portion of the partition wall 10 of the inner housing 3, and is disposed between the pin-like terminals 2 and 2, and is communicated with the retaining member insertion groove 12. An engagement post 23, having at its distal end a completely-retaining projection 22 for the retaining member 7, is provided in the space 21. Provisionally-retaining projections 24 for the retaining member 7 are formed on the opposite side walls of the retaining member insertion groove 12.

As shown in FIG. 1, the pin-like terminal 2 has a larger-diameter portion 26 extending from a proximal portion of a pin-like electrical contact portion 25. An engagement groove 27 is formed in the periphery of the larger-diameter portion 26 at the front end thereof, and is disposed in the terminal insertion hole 11. The larger-diameter portion 26 has at its rear portion a clamping contact portion of a cylindrical shape for clamping an end portion of a conductor 29 of an electrical wire 28.

The retaining member 7 is engaged in the engagement groove 27 to prevent a rearward withdrawal of the pin-like terminal 2. As shown in FIG. 2, the retaining member 7 is in the form of a flat plate, and has at its upper end portion a push operating portion 31 conforming in shape to the outer surface of the top wall 15 of the inner housing 3, and has at its lower portion a pair of semi-circular terminal retaining portions 32 and 32 each generally conforming in shape to the larger-diameter portion 26 of each of the pair of pin-like terminals 2 and 2. An outer end portion 33 of the terminal retaining portion 32 is progressively decreased in thickness to be flexible, and a retaining projection 34 for the provisionally-retaining projection 24 of the inner housing 3 is formed on the distal end of this outer end portion 33. A pair of retaining arms 35 and 35 for the completely-retaining projection 22 are formed at the central portion of the retaining member 7, and extend vertically along the slit-like space 21, each of the retaining arms 35 being supported at its both ends. The arms 35 are formed by forming flexing slits 36, so that each arm 35 is flexible to displace a retaining projection 37 formed on the central portion of the arm 35.

In the provisionally-retained condition in which the retaining projections 34 slide respectively over the provisionally-retaining projections 24, and the projections 37 of the retaining arms 35 are abutted against the completely-retaining projection 22, the retaining member 7 allows the pin-like terminal 2 to be inserted into the inner housing 3, and also the push operating portion 31 is projected outwardly from the outer housing 4 through the window hole 6 to prevent the sliding movement of the outer housing 4.

The top wall 5 of the outer housing 4 has at its rear end an engagement portion 38 which can be sequentially engaged with the wide window hole 6 for the retaining member 7, the provisionally-retaining projection 16 and the completely-retaining projection 19 on the top wall 15 of the inner housing 3. Engagement holes 41 and 42 for the corresponding completely-retaining projections 19 are formed respectively in side walls 39 and a bottom wall 40 of the outer housing 4 at the rear end portion thereof. The outer housing 4 is in the provisionally-retained condition, with the engagement portion 38 engaged with the provisionally-retaining projection 16. Formed at the front end of the top wall 5 is an engagement portion 43 for a lock arm of the mating connector (not shown). This mating connector is inserted into the outer housing 4 from its front open end 44 toward the inner housing 3.

Figure 4:
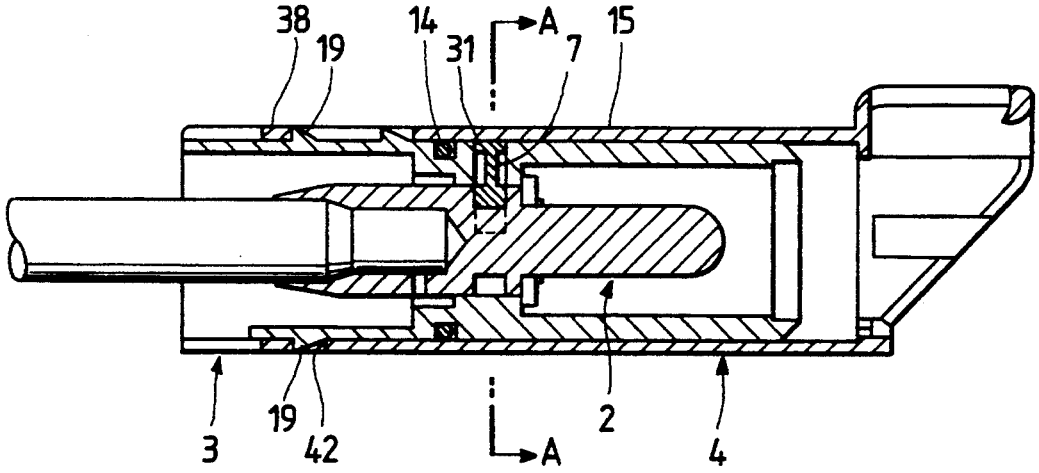
FIG. 4 is a vertical cross-sectional view, showing the terminal retaining member in its completely-retained condition.
Figure 5:
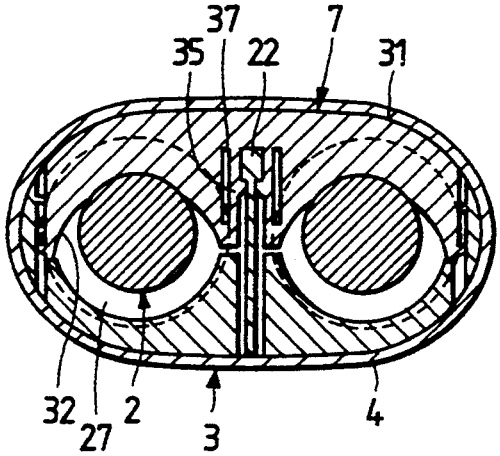
FIG. 5 is a cross-sectional view taken along the line A—A of FIG. 4.
Figure 6:
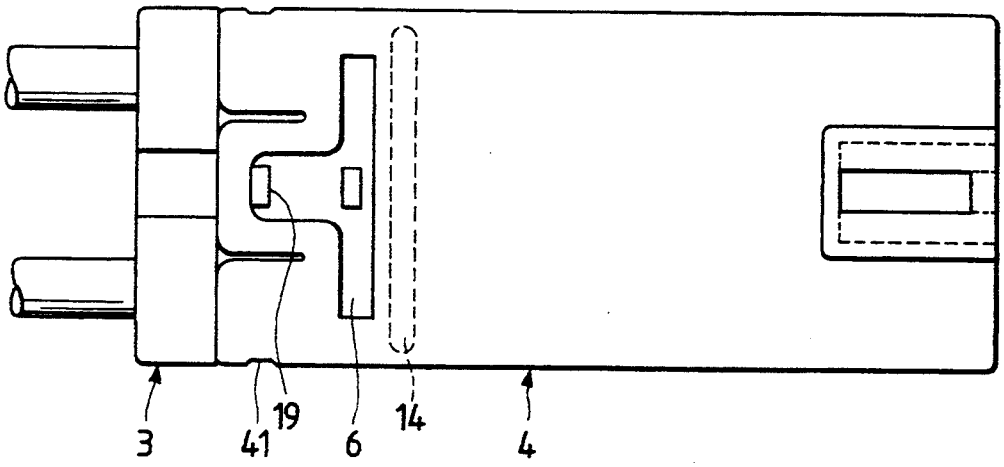
FIG. 6 is a top plan view.
Figure 7:
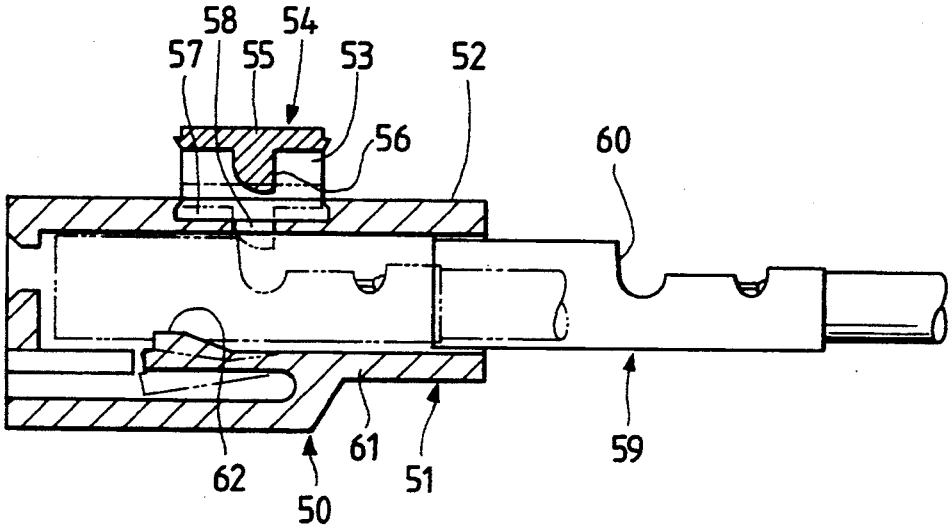
FIG. 7 is a vertical cross-sectional view of a conventional example.

FIG. 4 is a vertical cross-sectional view, in which the retaining member 7 shown in the provisionally-retained condition in FIG. 3 is completely retained in the inner housing 3, and the outer housing 4 is completely retained relative to the inner housing 3 by sliding the outer housing 4 in the direction of connection of the terminal. FIG. 5 is a cross-sectional view taken along the line A—A of FIG. 4, and FIG. 6 is a top plan view.

More specifically, the retaining member 7 is pressed down to engage each semi-circular terminal retaining portion 32 in the engagement groove 27 in the corresponding pin-like terminal 2, and at the same time the retaining arms 35 are flexed, so that the retaining projections 37 pass past the completely-retaining projection 22 of the inner housing 3, and are retainingly engaged therewith. In this condition, the push operating portion 31 at the upper end of the retaining member 7 lies flush with the outer surface of the top wall 15 of the inner housing 3, and is not projected outwardly therefrom. Therefore, the outer housing 4 can be slidingly moved in the direction of connection so that a terminal of the mating connector (not shown) can be connected to the pin-like terminal 2.

The completely-retaining projections 19 of the inner housing 3 are engaged respectively with the engagement portion 38 and the engagement holes 41 and 42 in the peripheral wall of the outer housing 4, so that the outer housing 4 is held in the completely-retained condition. The packing 14 mounted around the periphery of the inner housing is disposed forwardly of the window hole 6 in the outer housing 4, thereby completely preventing water from intruding through the window hole 6.

As described above, in the present invention, if the retaining member is not completely fitted, and hence does not retain the terminals, the outer housing can not be slidingly moved. Therefore, the connector will not be passed to the next step in such a manner that the terminals are incompletely retained, and the rearward withdrawal of the terminals during the transport or in use is prevented.

What is claimed is:

1. A connector having a terminal retaining mechanism for retaining a terminal in said connector, said connector being adapted to be mated with another connector and comprising:

an inner housing accommodating the terminal therein, said inner housing having an insertion groove therein;

an outer housing slidably mounted on said inner housing so as to be moveable from a provisionally retained position to a completely retained position, said outer housing having a window therein which is aligned with said insertion groove of said inner housing when said outer housing is in said provisionally retained position;

retaining means insertable into said insertion groove through said window for retaining the terminal in said inner housing, wherein said retaining means projects through said window when said retaining means is disengaged from the terminal so as to prevent said outer housing from being moved to said completely engaged position, and said retaining means is received in the inner housing when said retaining means is engaged with the terminal thereby allowing said outer housing to slide in a terminal connecting direction to the completely retained position.

2. A connector as claimed in claim 1, said retaining means includes:

a retaining member retaining the terminal;

an engaging post having completely retaining projection which is engaged with said retaining member; and a provisionally retaining projection formed on inner wall of said inner housing.

3. A terminal retaining mechanism as claimed in claim 2, wherein said retaining member is engaged with the provisionally retaining projection and the completely retaining projection when disengaged from the terminal.

4. A connector as claimed in claimed in claim 1, further comprising:

sealing member positioned between said inner housing and said outer housing.

* * * * *